US007431631B2

(12) United States Patent
Fildan et al.

(10) Patent No.: US 7,431,631 B2
(45) **Date of Patent: *Oct. 7, 2008**

(54) LAMINATED BRASSIERE WING

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 522 days.

This patent is subject to a terminal disclaimer.

(21) Appl. No.: 11/025,679

(22) Filed: Dec. 28, 2004

(65) Prior Publication Data

US 2006/0094335 A1 May 4, 2006

Related U.S. Application Data

(63) Continuation-in-part of application No. 10/978,238, filed on Oct. 29, 2004.

(51) Int. Cl.
*A41C 3/00* (2006.01)
*A41C 3/12* (2006.01)

(52) U.S. Cl. ..... 450/71; 450/82

(58) Field of Classification Search ..... 450/58, 450/63, 71, 72, 73, 82, 80, 79, 85; 24/682.1, 24/687–692, 620–622; 2/96, 336, 338, 321, 2/322

See application file for complete search history.

(56) References Cited

U.S. PATENT DOCUMENTS

| | | | | |
|---|---|---|---|---|
| 3,772,899 | A * | 11/1973 | Novi | 66/176 |
| 3,964,491 | A | 6/1976 | Martini | |
| 4,261,366 | A | 4/1981 | Lamborn | |
| 4,295,469 | A | 10/1981 | Lindgren | |
| 4,411,269 | A | 10/1983 | Weintraub | |
| 6,622,312 | B2 | 9/2003 | Rabinowicz | |
| 6,645,040 | B2 | 11/2003 | Rabinowicz et al. | |
| 6,824,445 | B2 | 11/2004 | Oneyear et al. | |
| 6,837,771 | B2 * | 1/2005 | Falla | 450/39 |
| 6,925,692 | B2 * | 8/2005 | Yang | 24/681 |
| 7,128,635 | B1 * | 10/2006 | Liu | 450/39 |

* cited by examiner

*Primary Examiner*—Gloria Hale
(74) *Attorney, Agent, or Firm*—Andrew Wilford

(57) ABSTRACT

A brassiere is made by attaching prefabricated wings provided with back closures to front parts of the brassiere. The wings are laminated with at least two layers of fabric and may have cushion layers between the fabric layers, without stitched seams.

10 Claims, 7 Drawing Sheets

LAMINATED BRASSIERE WING

CROSS REFERENCE TO RELATED APPLICATION

This application is a continuation-in-part application of our copending application Ser. No. 10/978,238 filed 29 Oct. 2004.

FIELD OF THE INVENTION

Our present invention relates to a brassiere and, more particularly, to a brassiere with laminated back wings which may be an integral part of the brassiere or may be marketed separately and assembled with brassiere cups to form the brassiere. The invention also relates to a method of making a brassiere and to an improved method of providing adjustable closures for the back of the brassiere.

BACKGROUND OF THE INVENTION

In a back-closure brassiere, the back of the brassiere structure is conventionally formed by a pair of wings, one of which can be provided with at least one male closure member while the other is provided with at least one female closure member cooperating with the male closure member. The male closure member can be, for example, a metal hook while the female closure member can be an eye.

More recently, it has been proposed to provide closure members which are equivalent to hook and eye fasteners but are fabricated from plastic, e.g. by injection molding the fastener members onto tapes which are stitched or bonded otherwise to the fabric of the wings forming the back of the brassiere. Reference may be had to U.S. Pat. Nos. 6,321,419 and 6,557,232 in that regard. A unique property of the plastic fasteners there described is that they also have a push-button function, i.e. the male member can be snapped into the female member by the application of pressure, in addition to being engageable with it in a sliding hook and eye function.

Generally the fabric wings of a brassiere are somewhat elastic for comfort and for that purpose are composed of elastic fabric. The straps carrying the fastener can be applied by stitching, in which case the wings of the brassiere may have several stitched seams. Stitched seams, however, are not always comfortable and in some cases may prove to be an irritant to the wearer.

Mention should also be made of the fact that any fastener member applied to the fabric of a brassiere wing in the past has projected from the surface of the fabric to an extent that it also could prove to be an annoyance to the wearer.

Finally it should be noted that the wings forming the back of a brassiere frequently are anchor points for shoulder straps of the brassiere. In the past the location of the anchor point for the shoulder strap along the brassiere has not generally been adjustable and it has also not generally been possible to select the manner in which the shoulder strap is secured at the anchor point. In short, the versatility of a brassiere with respect to adjustment of shoulder straps to the wings forming the back of the brassiere has left much to be desired.

OBJECTS OF THE INVENTION

It is, therefore, the principal object of the present invention to provide an improved brassiere and particularly an improved wing construction for a brassiere whereby the aforementioned drawbacks are avoided.

A more specific object of the invention is to provide a brassiere with an improved back wing construction which is more comfortable, more versatile and more easily fabricated than earlier brassieres.

Another object of this invention is to provide for increased comfort of plastic snap-button hook and eye fasteners for the back wing of a brassiere.

A further object of this invention is to provide an improved method of making a brassiere.

It is also an object of the invention to provide a brassiere of greater versatility with respect to shoulder strap attachments.

Another object of this invention is to provide an improved male fastener system for the brassiere wings of the aforementioned application which tends to resist the bending of the outer flap away from the inner flap when the back fasteners are engaged.

It is also an object of this invention to provide an improved sandwich system D-ring, particularly for the improved brassiere of the prior application but also for any lingerie applications.

SUMMARY OF THE INVENTION

These objects are attained, in accordance with the invention by providing brassiere wings which form the back of a brassiere and can be attached to the cups which form the front of the brassiere and which are of a laminated construction, i.e. are formed by at least two layers of an elastic fabric sandwiching between them a layer of a cushioning material, e.g. a fabric such as a so-called distance knit which, in the laminate, provides a certain degree of compressibility in a direction perpendicular to the fabric plane.

When we refer to a laminate here, we mean that the fabric layers are bonded together without the formation of a seam, e.g. by thermal bonding or welding or by the use of adhesive such as a hot melt adhesive at selective locations or even by less preferred methods utilizing bonding foils or films between the layers. Each wing as thus formed can be completely free from any stitching seam and the wing closures not provided with a continuous bonding film, can remain permeable to air or breathable. Where the cushion layer extends over the full area of the wing, it should also be elastic, although it is preferably nonelastic where it is provided only in regions in which the fasteners are disposed.

According to the invention the male and female fasteners of the combined snap and hook and eye type are applied directly to the laminated wing and likewise form a sandwich structure with one part lying on one surface of the wing and another part lying on the opposite surface of the wing but welded to the first part through the laminate so that the laminate is in turn sandwiched between the two fastener parts. Because a cushion layer is provided, as has been described, the fastener is pressed into the laminate and is in part reset therein to prevent that fastener from pressing against the skin of the wearer and contributing to wearer discomfort. It will be clear that the fasteners are provided directly on the wings and thus are not initially provided on a strap which must be secured to the wing. They indeed may even be injection molded directly on the wing if desired.

In accordance with the principles of this invention, at least one of the fastener halves, e.g. the male or female fastener half and preferably the female fastener half may be provided in at least one row on the respective wings so that a degree of adjustability is provided when the wings are connected together with those fasteners.

In accordance with a feature of the invention, a plurality of button-type fasteners may be provided in a row along an upper edge of the wing for selective engagement by a button on a shoulder strap, thereby providing a degree of adjustability for connection of the shoulder strap to that wing. One or more D-rings may be connected to each wing as well, also by having the support for the D-ring engage the laminate in a sandwich construction for use when a D-ring attachment of the shoulder strap is desired.

With respect to the method of fabrication, while the wings may be part of the brassiere structure originally and can have the fasteners then applied thereto, we can make the wings themselves, apart from the brassiere as a whole, apply the fasteners to them and deliver the completed wings to a brassiere manufacturer who can been join the prefabricated wing with the cup to produce the brassiere.

While the button fasteners which were used in the system originally described in the aforementioned application, namely, the button-type fasteners of U.S. Pat. No. 6,557,232 have been found to be highly successful, we have noted that the overlying flap when the wings are connected together, may have a tendency to stand away from the back of the wearer. We have now found that we are able to counteract that tendency by providing the fastener on the outer flap with a bar-shaped extension which appears to obviate that tendency and indeed can allow the outer fastener member to be made somewhat thinner and thus reduce the overall thickness of the interconnected back wings.

With respect to the attachment of the strap to the wings, we have discovered that it is advantageous to provide D-rings in a sandwich structure with a loop which can be opened and closed to allow insertion of the brassiere strap and its retention without operations involving threading of an end through the D-ring.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
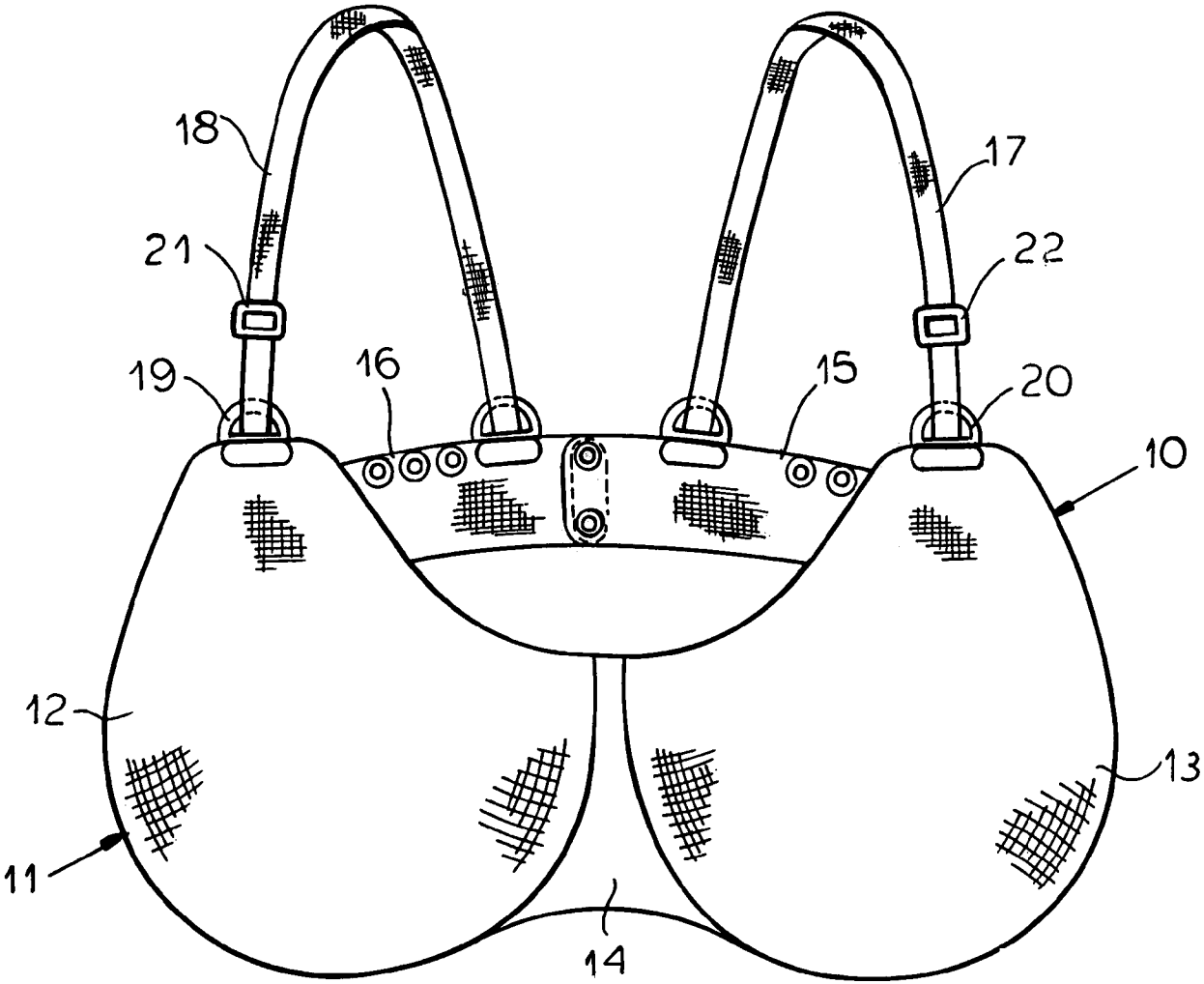
FIG. 1 is a front view in highly diagrammatic form of a brassiere provided with the wings of the invention.

In FIG. 1 we have shown a brassiere 10 which is formed from a brassiere front 11 having a pair of brassiere cups 12 and 13 connected by a center piece 14. To this brassiere front, respective wings 15 and 16 can be connected by stitching along edges of those wings remote from their respective fasteners. The brassiere is completed by a pair of shoulder straps 17 and 18 which are shown to engage in D-rings 19 and 20 at the cups 12 and 13, respectively and to have adjustment buckles 21 and 22 as is conventional.

At the back of the brassiere, formed by the wings 15 and 16, the straps 17 and 18 engage in D-ring fasteners which will be described in greater detail in connection with FIG. 2.

Figure 2:
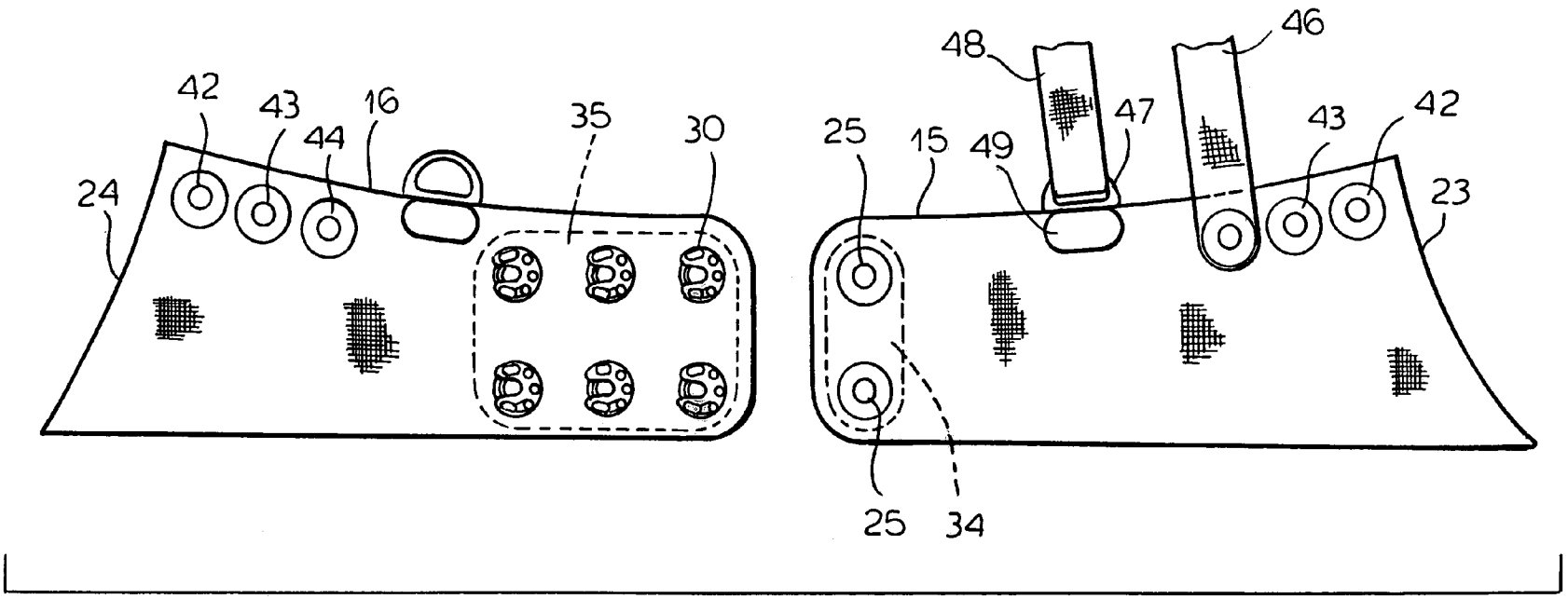
FIG. 2 is an elevational view of the wings prior to attachment to a brassiere front to form the brassiere of FIG. 1.

As can be seen from FIG. 2, the wings 15 and 16 are originally fabricated separate from the front of the brassiere and have edges 23 and 24 which can be stitched to the edges of the brassiere front at the respective cups. The attachment to the brassiere front may be made by the brassiere manufacturer and the wings can be supplied as prefabricated units to the manufacturer.

Figure 5:
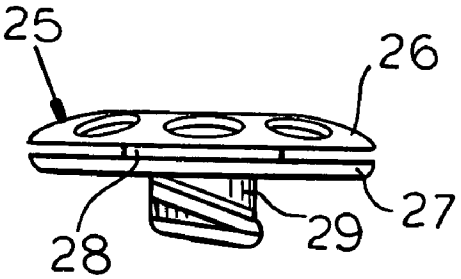
FIG. 5 is an elevational view of a male fastener member.

As is also apparent from FIG. 2, the wing 15 may have a pair of male fasteners 25 of the type described in U.S. Pat. No. 6,557,232, i.e. having a member 26 (FIG. 5) adapted to be disposed on one side of the wing, say the inside, and a member 27 adapted to be disposed on the outside is bridged by a portion 28 traversing the fabric of the wing and allowing the two members to be welded together. The pin 29 on the member 27 forms the male formation engageable in a snap fit or hook and eye connection in a corresponding female fastener such as the fastener 30 shown in FIG. 2.

The members 26 and 27 thus sandwich the laminate formed by the wing 15 between them.

Figure 3:
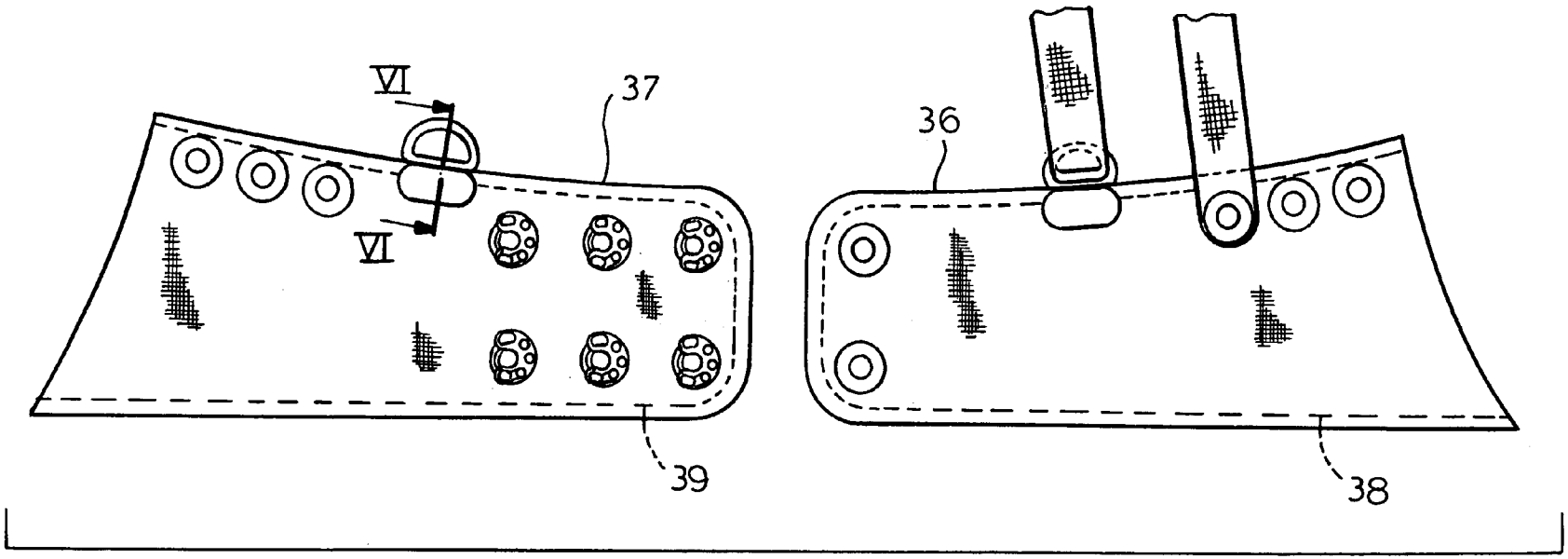
FIG. 3 is a view similar to FIG. 2 illustrating a second embodiment.
Figure 4:
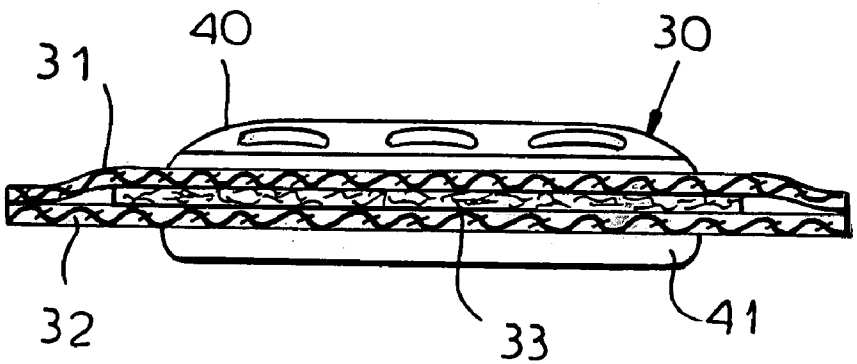
FIG. 4 is a cross sectional view through one of the female fasteners showing the sandwiching of the laminate between the members thereof.

As can be seen from FIG. 4 which shows a section through a wing 24, each wing may comprise an elastic fabric layer 31 and an elastic fabric layer 32 between which a cushion layer 33 can be located. Thus the cushion layer 33 is also sandwiched between the elastic fabric layers 31 and 32. In FIG. 2, the cushions 34 and 35 formed by the layer 33 are provided only in the regions of the fasteners 25 and 30. In this case, the cushions can be inelastic. In the laminates forming the wings 36 and 37 of FIG. 3, the cushions 38 and 39 extend substantially over the entire area of the wings.

As can be seen from FIG. 4 as well, each of the female members 30, two rows of which are provided in the embodiment of FIG. 2, has members 40 and 41 on opposite sides of the laminate and welded through them. The cushions are yieldable perpendicular to the planes of the laminate so that in practice, the members 40 and 26 which may lie against the skin of the wearer can be somewhat indented into the respective laminate so that the brassiere does not apply pressure at these points against the wearer.

From FIG. 2 it will also be apparent that the wings 15 and 16 are completely free from stitched seams which can cause irritation to the wearer.

Figure 6:
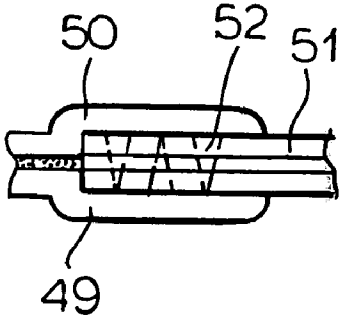
FIG. 6 is a cross sectional view through the D-ring fastener of FIG. 3 taken along the line VI-VI.

The wings can each also have a row of snap fasteners 42, 43, 44 at which snaps 45 on a shoulder strap 46 can selectively engage. Alternatively the D-ring fastener 47 can engage a shoulder strip 48. The D-ring 47 can have its shields 49, 50 welded together through the laminate 51 by pins or spikes 52 on the shields which pierce the laminate (see FIG. 6). To laminate the fabric layers to each other and the cushion layer, hot melt adhesive spots may be applied between the layers and then they can be pressed together with heating to produce a seam-free bond.

Figure 7:
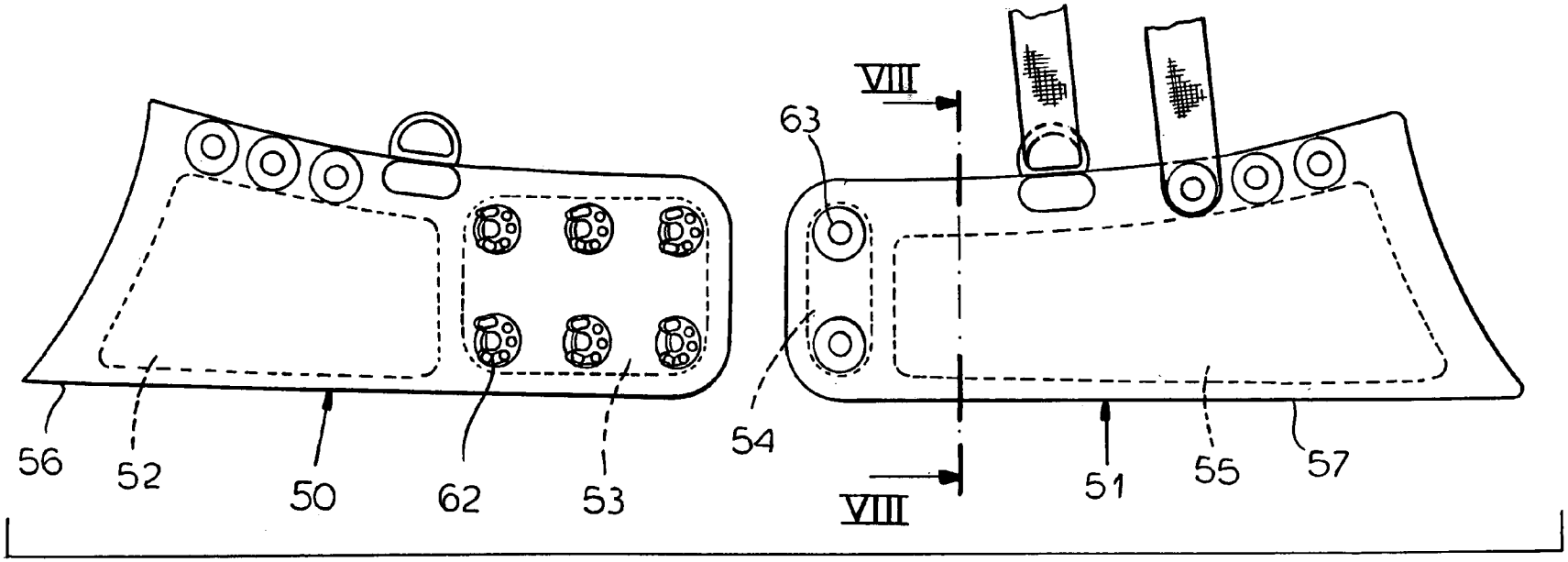
FIG. 7 is a view similar to that of FIGS. 2 and 3 but illustrating an embodiment in which there is a combination of inelastic and elastic cushions in each wing.
Figure 8:
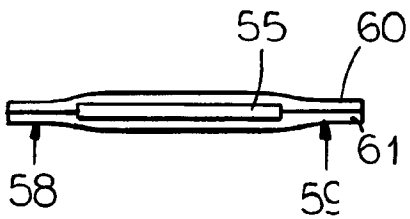
FIG. 8 is a diagrammatic cross section taken along the line VII-VII of FIG. 7 showing the lamination along the edges of a wing in which the two layers of fabric are laminated together without a cushion therebetween.

In the embodiment of FIG. 7, the wings 50 and 51 are each characterized by the fact that the spacing of the cushions 52, 53, 54 and 55 from the outer edges 56 and 57 of the wings is at least 2 to 5 mm, thereby leaving regions such as have been shown at 58 and 59 in FIG. 8, outwardly of a cushion, e. g. 55, two layers of fabric 60 and 61 are laminated together without a stitch seam and without a cushion between them. This makes the edge of the wing extra soft and flexible. The cuts through the material forming the edges 56 and 57 all around each wing are made by knife cutting rather than ultrasonic cutting to retain the soft and flexible hand. Ultrasonic cuts tend to make the edges sharp and hard because of the melting of the material.

Naturally, in accordance with the invention, the wings may be laminated from two layers of elastic fabric without any cushion between them if desired.

The embodiment of FIG. 7 is also distinguishable from that of FIGS. 2 and 3 in that it combines a cushion-form elastic 52, 55 sandwiched between the two fabric layers 60, 61 and inelastic cushions 53 and 54 located in the regions of the female fasteners 62 and the male fasteners 63 as have been described.

Figure 10:
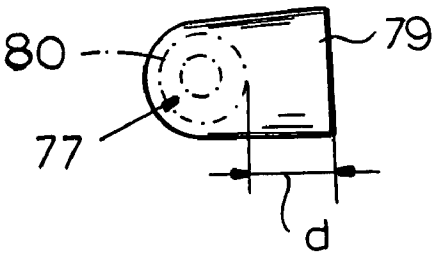
FIG. 10 is an illustration of the outer fastener member in an elevational view.
Figure 9:
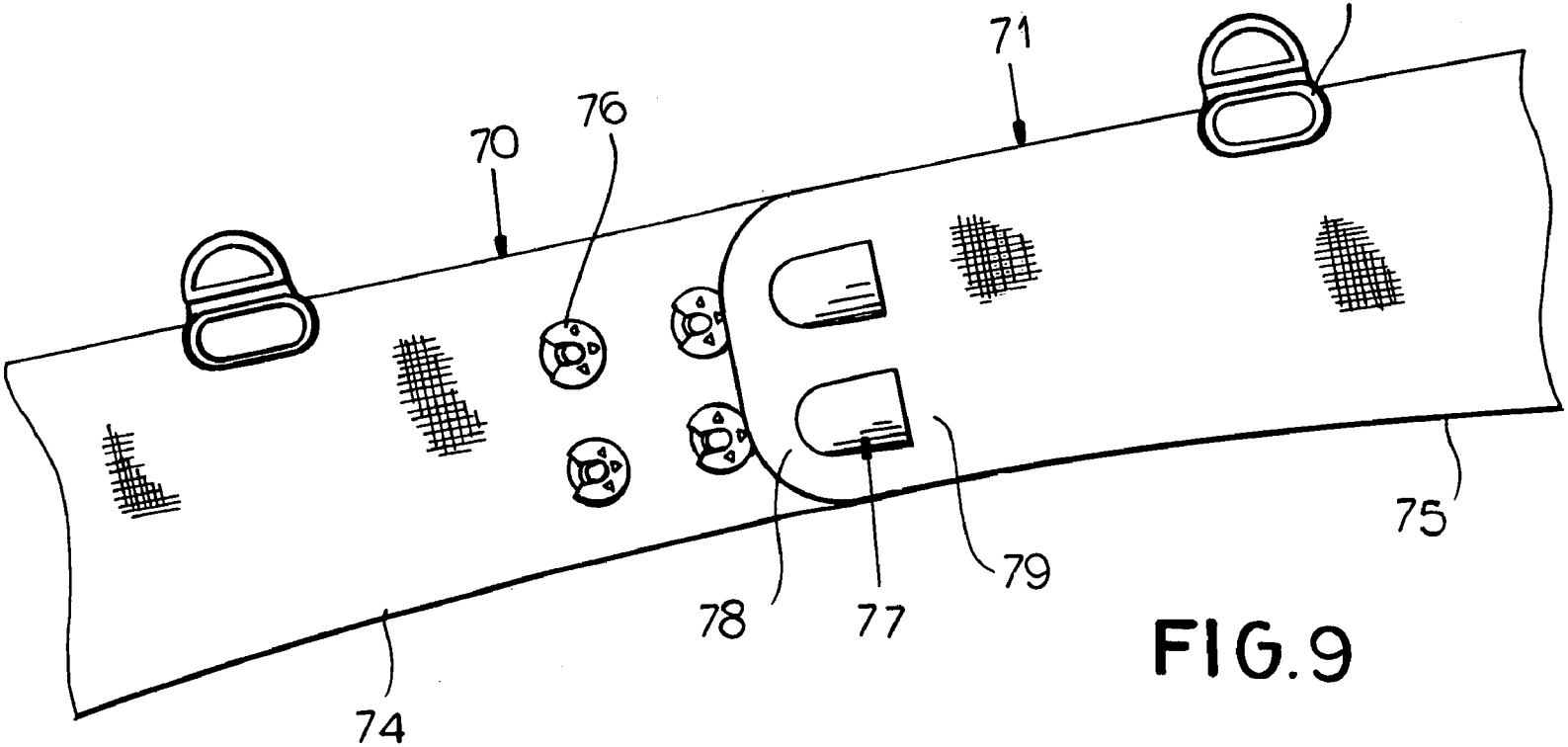
FIG. 9 is an elevational view showing two wings connected together with an improved outer fastener member on the outer wing.
Figure 13:
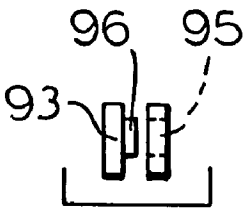
FIG. 13 is a diagram illustrating a locking arrangement for the D-ring of FIGS. 11 and 12.
Figure 14:
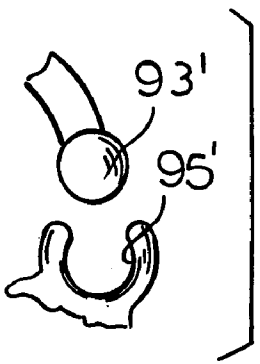
FIG. 14 is a diagram illustrating another locking arrangement according to the invention.

In FIG. 9 we have shown two wings 70 and 71 with respective sandwich-type D-rings 72 and 73 that are secured to the fabric 74, 75 of the wings and provided respectively with the female button fasteners 76 and the male button fasteners 77. In order to prevent the lifting edge 78 of the flap 79 that is outermost when the wings of the brassiere are connected together across the back of the wearer, the outer or male button fastener members 77 are formed in one piece with a bar 79 that is extended by a certain distance d (FIG. 10) rearwardly of the fastener portion 80. We have found that even a small extension rearwardly of a bar affixed to the male button portion 80 will keep the front edge 78 from turning away from the bottom flap.

Figure 11:
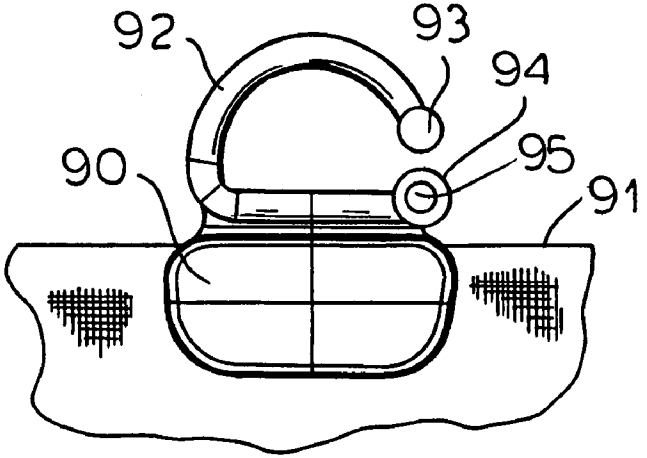
FIG. 11 is a view of a sandwich system D-ring in its open position.
Figure 12:
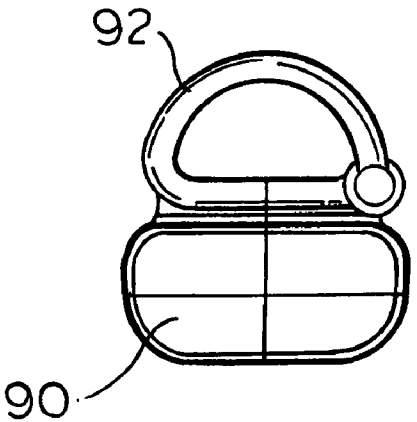
FIG. 12 is an elevation view of the same D-ring in the closed position.

As can be seen from FIGS. 11-14, the D-rings used in the various embodiments can be of the sandwich type, i.e. can have identical shields 90 on opposite sides of the fabric 91 and welded together through the fabric, e.g. with pins on the shields 90 penetrating through the fabric to the shield on the opposite side. The D-ring 92 can be openable, i.e. can have a male formation 93 engageable in a female formation 94. In FIG. 11 the D-ring is shown in its open position whereas it is closed in FIG. 12. To enable the male formation 93 to engage in the female formation 94, the female formation can have a hole 95 showing laterally and into which a boss 96 of the male formation 93 can snap. To open the D-ring, which is molded in one piece of synthetic resin material, for example polyoxymethylene, the parts 95 and 96 are laterally pulled apart. The strap (not shown in FIGS. 11 and 12) can then be inserted through the gap between the male formation 93 and the female formation 94.

Alternatively, the cylindrical head 93' forming the male formation can be snapped into the crescent-shaped seat 95' forming the female formation. Other locking systems can be used to secure the D-ring in its closed position.

We claim:

1. A brassiere comprising a pair of brassiere cups forming a front of the brassiere, a respective elongated wing connected to each of the cups and extending around a wearer of the brassiere to form a back of said brassiere, a first one of said wings lying directly against the skin of a wearer of the brassiere and having a free end provided with at least one first fastener member, a second one of said wings lying outward of the first wing and pressing said first wing against the skin of the wearer and having at least one second fastener member engageable with said first fastener member adjacent a free end of said second wing, and a bar formed on said second fastener member extending longitudinally of said second wing and limiting lifting of said second wing away from said first wing when said first and second wings are connected together by said fastener members across a back of the wearer.

2. The brassiere defined in claim 1 wherein said first fastener member is a circular press-button eye-type female fastener member and said second fastener member has a circular press-button side facing said first wing and a projection engageable in said female fastener member with a hook-in-eye action, said bar being provided on an opposite side of said second wing from said circular press-button side.

3. The brassiere defined in claim 2 wherein said first fastener member is one of a row of spaced-apart first fastener members provided on said first wing.

4. The brassiere defined in claim 3 wherein said first fastener member is one of two parallel rows of spaced-apart first fastener members provided on first wing, the second wing having two of said second members each engageable with a first member of a respective row.

5. The brassiere defined in claim 1 wherein each of said wings is provided with a D-ring engageable with a respective shoulder strap.

6. The brassiere defined in claim 5 wherein each D-ring is openable to receive the respective strap.

7. The brassiere defined in claim 6 wherein each D-ring includes a respective loop having an end provided with a formation detachably engageable with another formation to lock the D-ring closed.

8. The brassiere defined in claim 7 wherein said formation on the end of each loop is a male formation and is engageable in a female formation.

9. The brassiere defined in claim 8 wherein each D-ring is injection molded of synthetic resin in one piece.

10. The brassiere defined in claim 1 wherein said wings are fabricated with the respective fastener member and are then attached to said front of said brassiere.

* * * * *